US007723597B1

(12) United States Patent
Tripp et al.

(10) Patent No.: US 7,723,597 B1
(45) Date of Patent: May 25, 2010

(54) 3-DIMENSIONAL MUSICAL KEYBOARD

(76) Inventors: Jeff Tripp, 37 Squam Rd., Rockport, MA (US) 01966; Paul DeRocco, 1064 Las Pulgas Rd., Pacific Palisades, CA (US) 90272

( * ) Notice: Subject to any disclaimer, the term of this patent is extended or adjusted under 35 U.S.C. 154(b) by 96 days.

(21) Appl. No.: 12/196,260

(22) Filed: Aug. 21, 2008

(51) Int. Cl.
*G10C 3/12* (2006.01)

(52) U.S. Cl. ..... 84/423 R; 84/601; 84/629; 84/658

(58) Field of Classification Search ..... 84/658, 84/629, 423 R, 601
See application file for complete search history.

(56) References Cited

U.S. PATENT DOCUMENTS

| | | | | | |
|---|---|---|---|---|---|
| 580,035 | A * | 4/1897 | Cahill | 84/601 |
| 1,853,630 | A * | 4/1932 | Martenot | 84/704 |
| 2,562,471 | A * | 7/1951 | Martenot | 84/423 R |
| 3,693,492 | A * | 9/1972 | Ohno | 84/436 |
| 3,818,114 | A * | 6/1974 | Okamoto | 84/629 |
| 4,068,552 | A * | 1/1978 | Allen | 84/236 |
| 4,498,365 | A * | 2/1985 | Tripp et al. | 84/658 |
| 4,665,788 | A * | 5/1987 | Tripp et al. | 84/658 |
| 4,933,807 | A * | 6/1990 | Duncan | 361/283.2 |
| 6,703,552 | B2 * | 3/2004 | Haken | 84/658 |

* cited by examiner

*Primary Examiner*—Jeffrey Donels
*Assistant Examiner*—Robert W Horn

(57) ABSTRACT

An improved 3-dimensional musical keyboard apparatus comprises a plurality of planar, longitudinally extending keys mounted for both downward depression and longitudinal displacement; spring components to return an unguided key to its at-rest position; means to limit the extent of key motion; sensing means to detect key position at any point in its range of motion; and electronic digital signal processor means responsive to key position signals and productive of musical control information. Additionally, it comprises a single line of contact structure for restraining keys from lateral motion; differential damping for the vertical and horizontal components of key motion; simplified means for signaling key center position in the displacement axis; and support for musical articulation in the direction of key displacement when a key is moving upward from a depressed position.

15 Claims, 4 Drawing Sheets

Figure 1A:
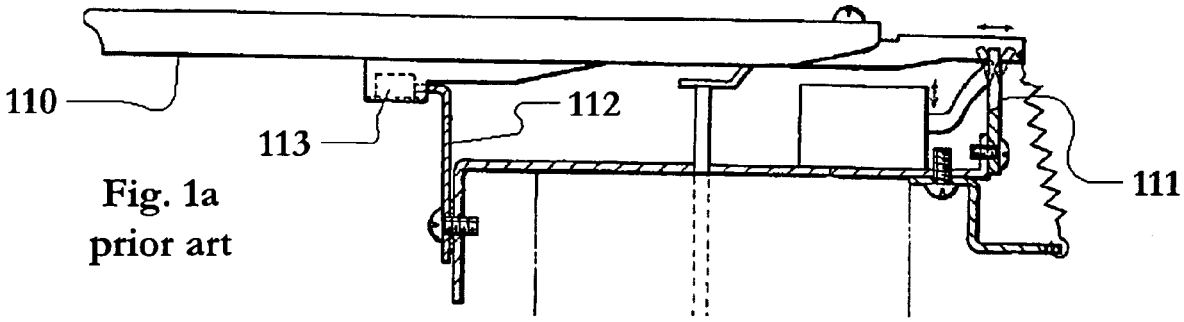
Fig. 1a prior art

210
211
212
213
214
215
216
217
218
219
220
221
222
223
224
225
226
227
228
229
230
231
232
233
234
235
236
237
4a
5a
6a
z
y
211a
212a
213a
214a
215a

3-DIMENSIONAL MUSICAL KEYBOARD

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field

The invention relates generally to a musical keyboard apparatus for controlling electronic sound, and specifically to those keyboards whose keys may be actuated both up-and-down and in-and-out.

2. Defined Terms

Positions and movements of keyboard elements are described from the point-of-view of a player facing the instrument.

The axis in which the plurality of keys is arrayed left and right is termed the x-axis, and motion in that axis is termed lateral, or side-to-side; the axis is which the long axes of the keys lie towards and away from the player is termed the y-axis, and motion in that axis is termed longitudinal, or in-and-out; and the axis in which the keys move up-and-down is termed the z-axis, and motion in that axis is termed vertical, or up-and-down.

Key movement in the z-axis is termed 'depression', or 'key dip', and key movement in the y-axis is termed 'displacement'.

A key is said to be in its 'at-rest' position when it is fully up in the z-axis, or undepressed, and centrally located in the y-axis, or undisplaced; and in an 'active position' when it is not at-rest.

The term 'unguided' refers to the state of a key that has been depressed, whether or not displaced, and released.

The term 'key space' refers to the locus of all positions in the vertical plane in which the long axis of a key lies to which the key may be moved.

Of the two key forms, 'upper-rank' keys are analogous to those commonly called 'black keys' in conventional claviers, and lower-rank' keys are analogous to those commonly called 'white keys' in conventional claviers.

3. Prior Art

Tone producing means and control means in acoustic instruments are tightly bound to each other. A drumhead, for example, may be struck by hand, or with a stick—a distinction with a difference—but not so much you wouldn't know it was a drum.

Control means for electronic sound, on the other hand, may be entirely separate from tone producing means. Drum sounds can be played via keyboards, though, as is well understood by those skilled in the art, without the control of actually drumming.

Almost a century of effort since the Telharmonium (U.S. Pat. No. 580,035 (1897), Cahill) first made the sounds of electrical circuits audible has gone toward devising control means as expressive as those of acoustic instruments. The Telharmonium utilized multiple keyboards having position sensitivity in the z-axis to expand expression, but the instrument weighed several hundred tons and cost millions of dollars to fabricate.

Less inherently expensive but still very limited was the keyboard of Maurice Martenot (U.S. Pat. No. 2,562,471 (1948), Martenot). This patent teaches a platform, displaceable in the x or y-axis direction, on which all keys are mounted. The platform's excursion is directed at effects that can be controlled with short motion, like vibrato, but is not useful for control of higher resolution sonic events like pitch bending. Further, Martenot recognizes that the platform, when unguided, will continue to oscillate as a function of its mass and springing, eventually losing energy. Such oscillation is inherently distracting to the player, all the more so if it has a hearable result. Martenot's solution, balancing mass and spring force so that the platform has a natural frequency higher than that of an effect like vibrato, attempts to hide the problem of damping, and can only work for low frequency sonic events.

One known way to expand the expressive capability of an electronic keyboard controller is to recognize individual key-based playing gestures made in the direction of the longitudinal axis of the keys, in-and-out, in the y-axis.

Robert Moog described at the International Computer Music Conference in 1982 a 'multiple-touch-sensitive keyboard', later completed with help from one of us (DeRocco). The key surfaces of its otherwise conventional organ/synthesizer style keyboard were circuit boards that continuously recognized finger location. In one of its playing modes, absolute location of the initial contact in the y-axis was treated as a starting point for modulation, and in another, location relative to a 'first touch', that is, a note-on condition following a note-off condition, was recognized. Whichever the mode, however, player perception and control was principally mediated through skin sensation rather than via the more discriminating flexors and extensors of the hand.

The same ergonomic limitation applies to the more contemporary instrument taught in U.S. Pat. No. 6,703,552 (2004), Haken. The instrument is an uninterrupted planar surface (a membrane keyboard) with very sophisticated processing to extract player intent; but it, too, like Moog's keyboard, does not use the hand's more complex sensing and control capabilities.

FIG. 1*a* is a side elevational view of the prior art of U.S. Pat. No. 3,818,114 (1974), Okamoto, showing a digitally operable electronic organ key with limited 3-dimensional capability. A key 110 is supported by a leaf spring 111 "resilient enough to permit each . . . [key] . . . to move back and forth in the lengthwise direction of each said key". Such motion is limited by interference between the 'white' key (as shown in the drawing) and a 'black' key (not shown). At the front end of the key, a member 112 supports a stop 113 at its upper end, which stop is "somewhat loosely received in a housing of any suitable shape formed on the underside of the key 110, in such a manner that the angle of swing of the key 110 is thereby delimited." That is, the stop is only directed at and suitable for z-axis motion. Thus Okamoto shows a digitally operable electronic organ key with limited 3-dimensional capability. Its longitudinal, or y-axis, motion is very short, of necessity, as there is little space between the front of black keys and 'L-shaped' portions of adjacent white keys. Short key travel is suitable only for sonically low resolution musical features, like tremolo. Significantly greater travel in the y-axis would be needed to control higher resolution sonic events, like pitch. Also, Okamoto makes no provision for frictionless guidance at the front of the key; increased friction under the natural lateral loads in playing, having no sonic purpose, only distract the player. Okamoto speaks specifically of the restraint at the front of the key as "somewhat loosely received in a housing of any suitable shape formed on the underside of the key, in such a manner that the angle of swing of the key is thereby delimited." The structure is directed only at z-axis motion and does not adequately support y-axis motion suited to control high resolution musical events. Finally, Okamoto makes no provision for physically signaling a key's center position in the y-axis.

Figure 1B:
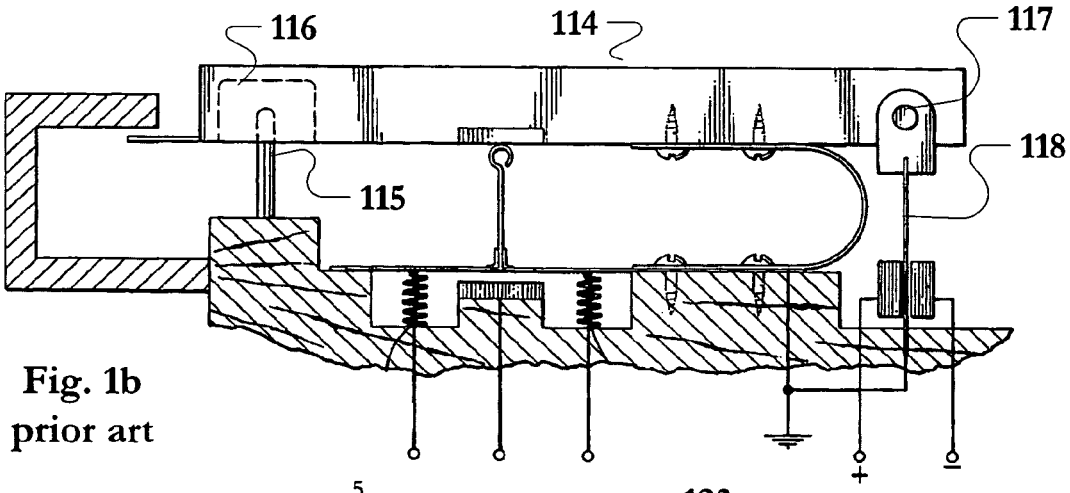
Fig. 1b prior art

FIG. 1*b* is a side elevation, partly sectionalized, view of the prior art of U.S. Pat. No. 4,068,552 (1978), Allen, showing an electronic key mechanism with extended 3-dimensional capability. The pin 115, which makes sliding contact with the inside of slot 116, is subject to binding if torsion is exerted on the key 114 through lateral loading, which is a natural component of playing. At the rear of the key, a pivoting mount is comprised of a yoke 117 to which the key 114 is pivotally pinned. The yoke 117 is then attached to a leaf spring 118. These joints are is a source of instability and play in the mechanism, require a complexity of parts, and the need for adjustment. While Allen describes an electronic key mechanism with extended key displacement range through the use of cantilevered, or undercut, 'black keys', the pin mechanism used to control lateral loads is susceptible to cocking and binding in its associated slot; no means is provided for damping the longitudinal oscillations of an unguided key; and the rear key mount requires a bearing in its upper aspect, at the expense of play which may be amplified over the length of the key, and shows a complexity of parts needing assembly and adjustment, and hampering long term reliability.

Figure 1C:
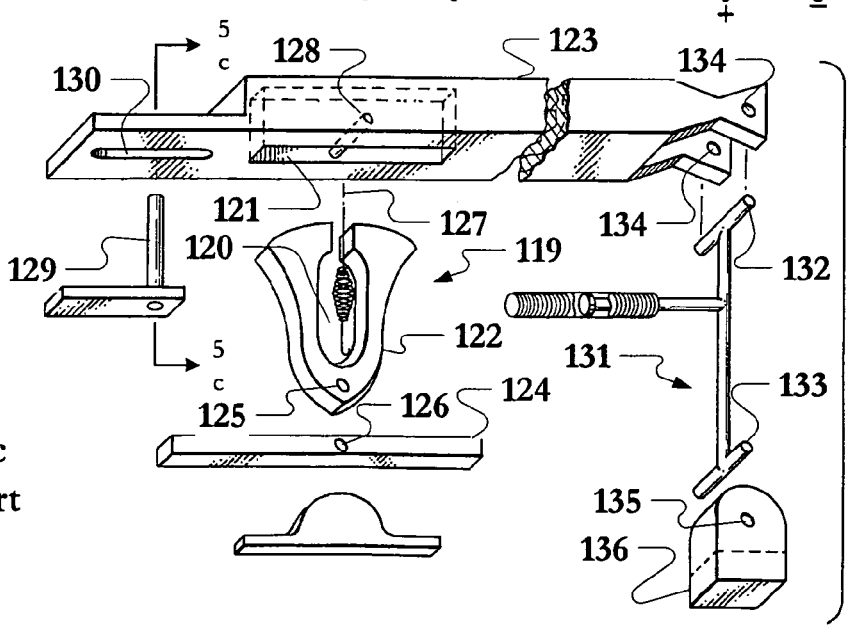
Fig. 1c prior art

FIG. 1*c* is an exploded view of the prior art of U.S. Pat. No. 4,498,365 (1985), Tripp et al., showing a pressure and longitudinal sensor coupled to a longitudinally displaceable key with extended 3-dimensional capability and center signaling. A rocker assembly 119 establishes a central detent for longitudinal key motion through a complexity of elements, including slots 120 and 121 in a rocker body 122 and a key 123, respectively. Rocker body 122 is pinned at one of its ends to a leaf spring 124 through holes 125 and 126 and attached at its other end by a coil spring 127 to a pin 128. A perpendicularly extending pin 129, inserts into a slot 130 in key 123, acts as a key travel limit and supplies lateral key motion restraint at the front of the key. A second rocker assembly 131 requires that pins 132 and 133, "mutually parallel and non-skewed", be assembled at one end into bearing holes 134 of key 123 and, at the other end, into hole 135 and its mate (not shown) in a bracket 136. The rocker assembly, which provides a central detent for longitudinal key motion, comes at the expense of a complexity of elements and of assembly and disassembly when pinning the rocker body both to the leaf spring at one end and the key at the other. No provision is made to damp both the z and y-axis components of unguided longitudinal key motion beyond the damping internal to the key/springs themselves. There is no means to resist substantially without play and friction lateral loads at the front of the key as longitudinal key guidance is supplied by a pin oriented perpendicularly in a slot, which is thus subject to cocking and binding. Lastly, a second rocker assembly at the rear of the key is complex to manufacture and assemble as well as a source of looseness in the keys and error in their mutual alignment.

Lastly, none of the prior art addresses how the mass of a key and the spring and player forces acting on it must be organized for player control simultaneously in the z and y axes, adding articulation to the sound.

SUMMARY

In accordance with the embodiment disclosed herein, an improved 3-dimensional musical keyboard apparatus is described to support more facile control of musical sound. It comprises a plurality of planar, longitudinally extending keys mounted for both downward depression and longitudinal displacement; spring components to return an unguided key to its at-rest position; means to limit the extent of key motion; sensing means to detect key position at any point in its range of motion; and electronic digital signal processor means responsive to key position signals and productive of musical control information. Additionally, it comprises a single line of contact structure for restraining keys from lateral motion; differential damping for the vertical and horizontal components of key motion; simplified means for signaling key center position in the displacement axis; and support for musical articulation in the direction of key displacement when a key is moving upward from a depressed position.

DRAWINGS

Figures

FIG. 1*a* is a side elevational view of the prior art of U.S. Pat. No. 3,818,114 (1974), Okamoto, showing a digitally operable electronic organ key with limited 3-dimensional capability FIG. 1*b* is a side elevation, partly sectionalized, view of the prior art of U.S. Pat. No. 4,068,552 (1978), Allen, showing an electronic key mechanism with extended 3-dimensional capability.

FIG. 1*c* is an exploded view of the prior art of U.S. Pat. No. 4,498,365 (1985), Tripp et al., showing a pressure and longitudinal sensor coupled to a longitudinally displaceable key with extended 3-dimensional capability and center signaling.

Figures 2A, 2B:
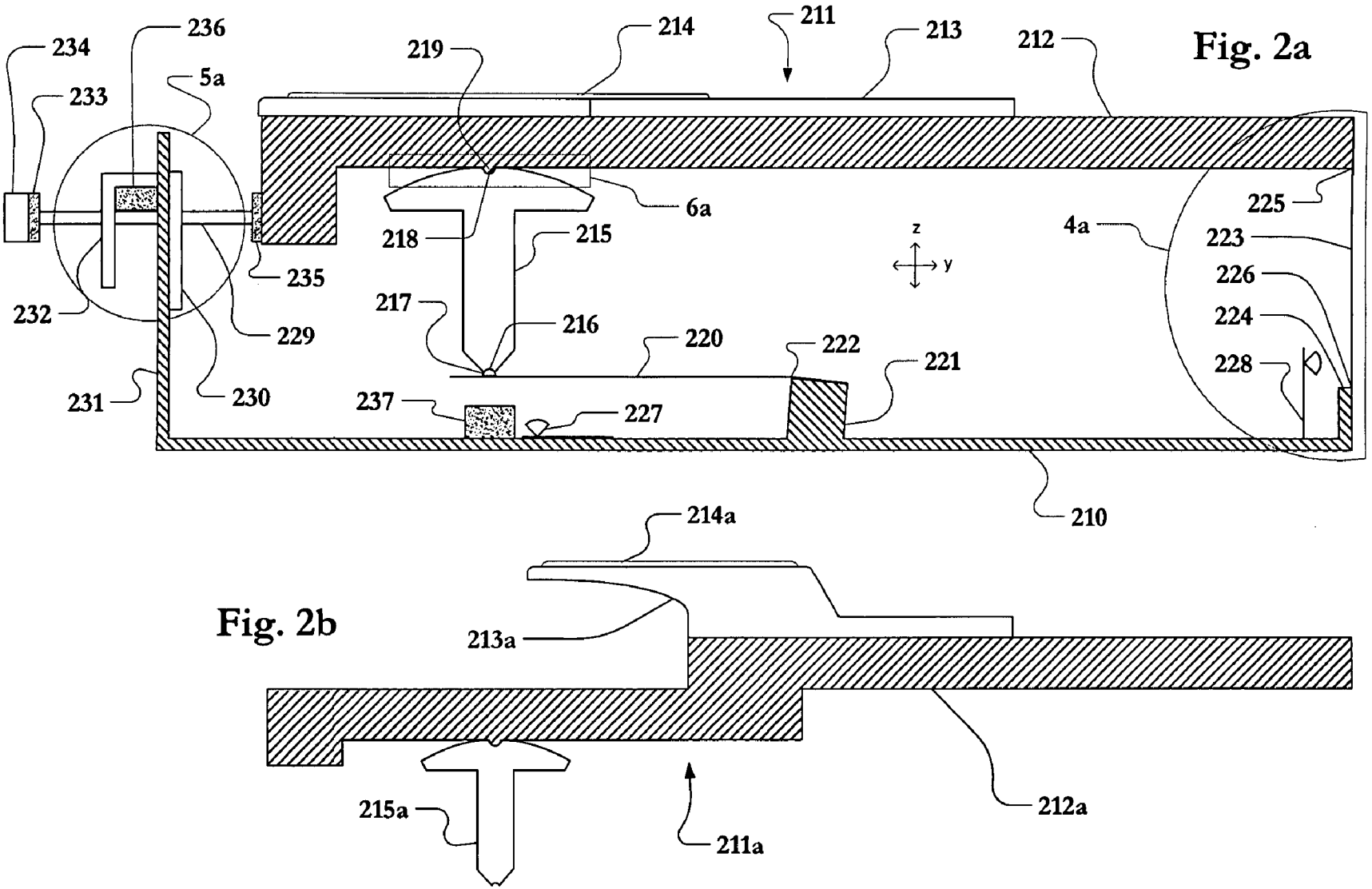

FIG. 2*a* is a side, elevational view of the present embodiment.

FIG. 2*b* is a side, elevational view of a second key form of the present embodiment.

Figure 3A:
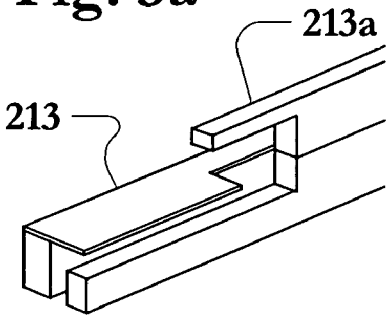

FIG. 3*a* is a perspective view of the two key forms of the present embodiment in their at-rest positions.

Figure 3B:
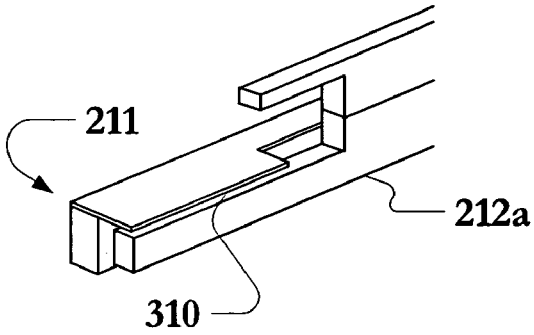

FIG. 3*b* is a perspective view of the two key forms of the present embodiment with lower rank key 211 depressed.

Figure 3C:
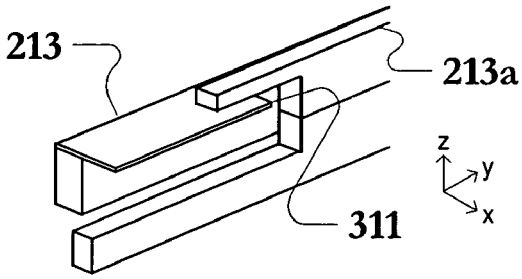

FIG. 3*c* is a perspective view of the two key forms of the present embodiment with upper rank key 211*a* depressed and displaced.

Figure 4A:
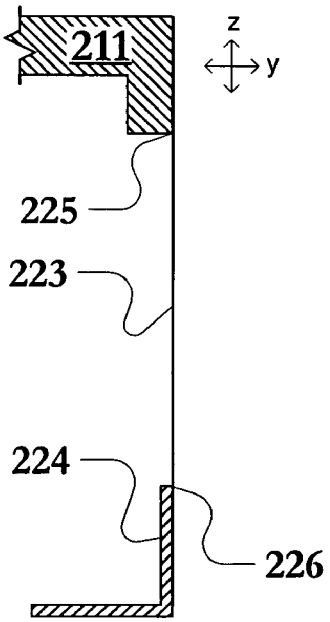

FIG. 4*a* is a side, elevational view of area 204 in FIG. 2*a* of the present embodiment, showing y-axis spring 223 in an undeflected state.

Figure 4B:
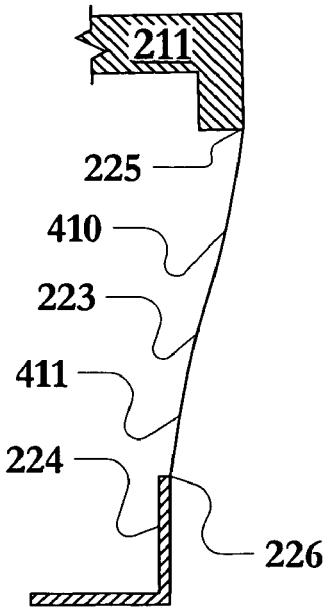

FIG. 4*b* is a side, elevational view of area 204 in FIG. 2*a* of the present embodiment, showing y-axis spring 223 in a deflected state.

Figure 4C:
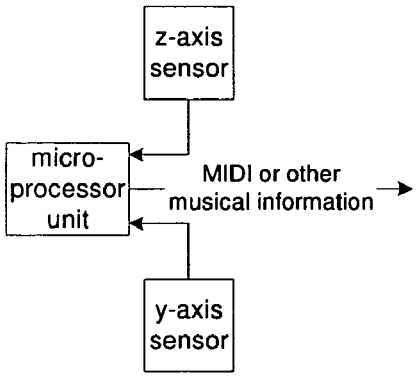

FIG. 4*c* is a block diagram of the present embodiment showing the relationship between the sensors and the electronic processor, including the output of the electronic processor.

Figure 5A:
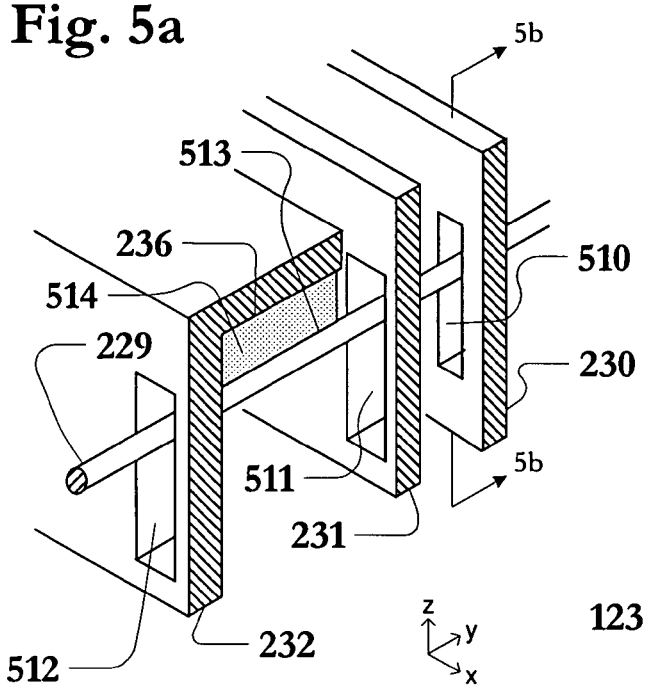

FIG. 5*a* is a perspective view, from the side and above and partially sectioned, of area 205 in FIG. 2*a* of the present embodiment.

Figure 5B:
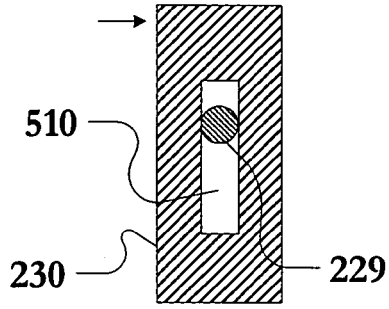

FIG. 5*b* is a front elevational view of pin 229 in slot 510 in guide plate 230 taken at section line 5*b*-5*b* in FIG. 5*a*.

Figure 5C:
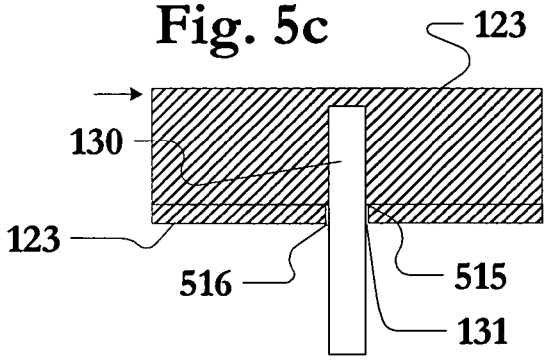

FIG. 5*c* is a front elevational view of pin 130 in slot 131 in key 123 taken at section line 5*c*-5*c* in the prior art of FIG. 1*c*.

Figure 6A:
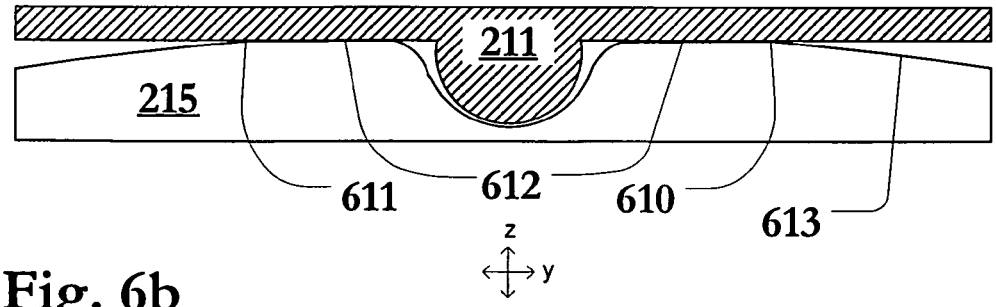

FIG. 6*a* enlarges for clarity area 206 in FIG. 2*a* of the present embodiment, showing the relationship of key 211 and rocker 215 when the key is centered in the y-axis.

Figure 6B:
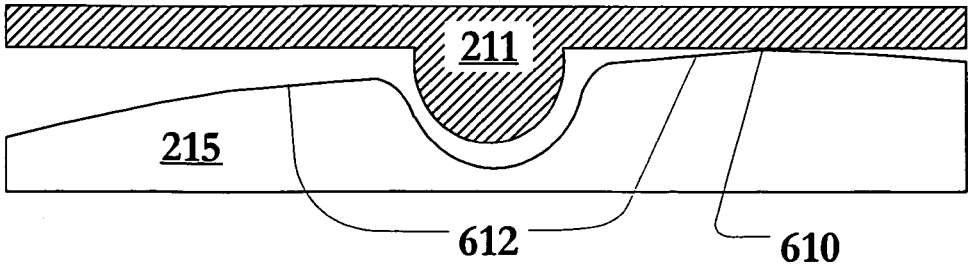

FIG. 6*b* enlarges for clarity area 206 in FIG. 2 of the present embodiment, showing the increased separation of key 211 and rocker 215 during initial displacement.

DRAWINGS

Reference Numerals

| | | | |
|---|---|---|---|
| 4a | y-axis area, FIG. 2a | 5a | guide area, FIG. 2a |
| 6a | rocker area, FIG. 2a | 110 | key |
| 111 | support | 112 | member |
| 113 | stop | 114 | key |
| 115 | pin | 116 | slot |
| 117 | yoke | 118 | spring |
| 119 | rocker assembly | 120 | slot |
| 121 | slot | 122 | rocker body |
| 123 | key | 124 | spring |
| 125 | hole | 126 | hole |
| 127 | spring | 128 | pin |
| 129 | pin | 130 | slot |
| 131 | rocker assembly | 132 | pin |
| 133 | pin | 134 | hole |
| 135 | hole | 136 | bracket |
| 210 | base structure | 211 | key |
| 211a | key | 212 | key body |
| 212a | key body | 213 | key top |
| 213a | key top | 214 | key surface |
| 214a | key surface | 215 | rocker |
| 216 | recess | 217 | projection |
| 218 | recess | 219 | projection |
| 220 | spring | 221 | projection |
| 222 | pivot point | 223 | spring |
| 224 | projection | 225 | pivot point |
| 226 | pivot point | 227 | sensor |
| 228 | sensor | 229 | projection |
| 230 | plate | 231 | projection |
| 232 | bracket | 233 | cushion |
| 234 | collar | 235 | cushion |
| 236 | cushion | 237 | cushion |
| 310 | relief | 311 | relief |
| 410 | shape | 411 | shape |
| 510 | slot | 511 | slot |
| 512 | slot | 513 | surface |
| 514 | interior | 515 | contact point |
| 516 | contact point | 610 | end point |
| 611 | end point | 612 | flat |
| 613 | surface | | |

DETAILED DESCRIPTION

Defined Terms

Positions and movements of keyboard elements are described from the point-of-view of a player facing the instrument.

The axis in which the plurality of keys is arrayed left and right is termed the x-axis, and motion in that axis is termed lateral, or side-to-side; the axis is which the long axes of the keys lie towards and away from the player is termed the y-axis, and motion in that axis is termed longitudinal, or in-and-out; and the axis in which the keys move up-and-down is termed the z-axis, and motion in that axis is termed vertical, or up-and-down.

Key movement in the z-axis is termed 'depression', or 'key dip', and key movement in the y-axis is termed 'displacement'.

A key is said to be in its 'at-rest' position when it is fully up in the z-axis, or undepressed, and centrally located in the y-axis, or undisplaced; and in an 'active position' when it is not at-rest.

The term 'unguided' refers to the state of a key that has been depressed, whether or not displaced, and released.

The term 'key space' refers to the locus of all positions in the vertical plane in which the long axis of a key lies to which the key may be moved.

Of the two key forms, 'upper-rank' keys are analogous to those commonly termed 'black keys' in conventional claviers, and lower-rank' keys are analogous to those commonly termed 'white keys' in conventional claviers.

Structure and Operation

FIGS. 2*a*-3*c*

FIG. 2*a* is a side, elevational view of the present embodiment. It shows a base structure 210 on which is mounted a planar, longitudinally extending key 211 of the lower-rank, comprised of a key body 212 to which a key top 213 having an upwardly facing playing surface 214 is firmly affixed. Key 211 is supported toward its front by a rocker 215 located generally under playing surface 214 and having, at its bottom, a recess 216 that locates rocker 215 on a projection 217 from a flat spring 220. At its top is a recess 218 into which an aligning projection 219 from key 211 extends without interference when key 211 is unguided and in its at-rest position.

Under the foregoing conditions, the two rocker recesses and their associated projections are aligned perpendicularly to base structure 210. Rocker 215 has a partially truncated, curvilinear upper surface. A flat spring 220, firmly affixed to an upward projection 221 from base structure 210 and rotatable at a pivot point 222, supports and captures rocker 215. The rear of key 211 is firmly affixed to the upper end of a flat spring 223 and the key is rotatable at pivot point 225. At the other end of spring 223, it is firmly affixed to an upward projection 224 from base structure 210 such that, when undeflected, it is perpendicular to base structure 210 and rotatable at pivot point 226.

Two non-contact sensors 227 and 228 are located near, and aimed directly at, the broad dimension of flat springs 220 and 223, respectively. At the front of key 211, a horizontally disposed, cylindrical projection 229 passes through a zero-clearance, vertical slot in a plate 230, then through vertical slots both having clearance in a projection 231 and a bracket 232. Both plate 230 and bracket 232 are firmly affixed to, and may be integral with, projection 231, which is generally perpendicular to base structure 210. A cushion 233, mounted on key projection 229, is interposed between a collar 234 and bracket 232, and a cushion 235, similarly mounted, is interposed between the frontmost, vertical face of key 211 and plate 230.

Finally, key 211 is limited in its movement upwards by a cushion 236, retained between projection 231 and bracket 232, and, at the bottom of its travel, by a cushion 237 supported by base structure 210.

FIG. 2*b* is a side, elevational view of a second key form of the present embodiment. It shows a planar, longitudinally extending key 211*a* comprised of a key body 212*a* to which a key top 213*a* having an upwardly facing playing surface 214*a* is firmly affixed.

FIG. 3*a* is a perspective view of the two key forms of the present embodiment in their at-rest positions, FIG. 3*b* is a perspective view of the two key forms of the present embodiment with lower-rank key 211 depressed, and FIG. 3*c* is a perspective view of the two key forms of the present embodiment with upper-rank key 211*a* depressed and displaced.

FIG. 3*a* shows that lower-rank key top 213 extends closer to the player than does upper-rank key top 213*a*, as is commonly the case in claviers. The two key forms may be arrayed as repeating groups of five upper-rank and seven lower-rank keys, commonly called 'octaves', or may be aggregated in other proportions and/or orders in comprising the intended plurality.

As may be seen in FIG. 3*b*, upper-rank key body 212*a* has a relief 310 in its forward aspect, to avoid interference between the key forms when they are not in their at-rest positions, in this case when lower-rank key 211 is depressed.

FIG. 3*c* shows that upper-rank key top 213*a* has a relief 311 in its forward aspect to avoid interference with that portion of lower-rank key top 213 lying in its longitudinal plane. The shapes of the keys, and, in particular, those of the key tops, may vary, as do those of conventional claviers, for example, without affecting their function. Other than the foregoing differences, there are no material differences in the structure and operation of the keys, and the structure and operation of any one key is representative of the structure and operation of all.

Referring again to FIG. 2*a*, base structure 210 is flat, where horizontal, to aid in aligning the key playing surfaces in their respective planes, and is rigid overall to maintain key alignment under the stresses of key actuation. It is preferably constructed from material that is both light and has a high stiffness-to-weight ratio, for example aluminum honeycomb panel or aluminum composite material. Key 211 is resiliently mounted to base structure 210 so that when unguided it comes to rest substantially centered in the y-axis direction and fully up in the z-axis direction. Its stability in the y-axis when at-rest is a function of the restoring forces of y-axis flat spring 223 and z-axis flat spring 220 and of the width of the truncation (or "flat") on rocker 215. More detail is provided in the discussion of FIGS. 6*a-b*, below.

Key 211 may be guided to any position in the plane in which its long axis lies, limited only by contact with stop cushions 233, 235, 236, and 237, whose exact positions may be adjusted for player preference in a variety of common ways including shims and hinged mounts. Cushions 233, 235 and 237 serve to absorb energy generally normal to their broad aspects and may be usefully made of piano felts, while cushion 236 may engage the projection 229 as key 211 moves in both the z and y-axis directions and may be usefully made of a skinned elastomeric foam, regarding which more detail may be found in FIG. 5*a* and its detailed description.

Key 211 is preferably of sufficient length to minimize: (a) diminishing playing leverage as the key is actuated increasingly closer to pivot point 225, and (b), the angle to which the playing surface 214 inclines from the horizontal when the key 211 is depressed. At a chosen length, key 211 must be stiff enough so as not to be affected by spurious inputs from unintended motion and/or lateral key-to-key contact. At a chosen length and stiffness, it must be light enough that the inertia imparted to it through impulse inputs in the z-axis and/or the y-axis is generally not greater than the restoring forces in those directions, insuring continuous control. To accomplish the foregoing, key 211 may be advantageously made of a composite material, for example, glass or carbon-fiber/epoxy, and key guide projection 229, preferably cylindrical in cross-section, may be made integrally with key body 212, or separately, using drill rod or the like. Z-axis flat spring 220 is preferably made of high-carbon, fully tempered spring steel; it flexes in simple bending at z-axis pivot point 222 whenever key 211 is depressed and for all measures of key displacement, urging key 211 upward to engagement with stop cushion 236

Key surface 214 and its analog, key surface 214*a* depicted in FIG. 2*b*, are preferably made of an elastomer of medium durometer whereby longitudinal motion control may be abetted through the conformity of the surface material under finger pressure; at the same time, the elastomer, silicone rubber, for example, should also have no palpable 'stickiness' when in contact with human skin, to insure unconstrained release of the keys when desired.

FIGS. 4*a*-4*c*

FIGS. 4*a* and 4*b* detail the operation of y-axis flat spring 223, which functions as a support, a pivot, and a resilient force. FIG. 4*a* is a side, elevational view of area 4*a* in FIG. 2*a*, showing y-axis spring 223 in an undeflected state, supporting key 211 in the key's at-rest position. FIG. 4*b* is a side, elevational view of area 4 in FIG. 2*a*, showing y-axis spring 223 in a deflected state, subsequent to key 211 having been both depressed and displaced.

Key depression is accommodated in a frictionless and substantially resistance-less way at y-axis upper pivot point 225. If y-axis flat spring 223 is made of AISI 1095 high-carbon, fully tempered spring steel feeler gauge stock, for example, it will flex at that point without fatiguing. Longitudinal force on key 211 causes y-axis flat spring 223 to bend rearward frictionlessly and within its elastic limit at a pivot point 226; as a result, the spring adopts a characteristic double-bighted shape 410 and 411, generating more force for a given measure of key displacement than it would were it to bend as a simple cantilever over the same measure of displacement.

FIG. 4*c* is a block diagram showing the relationship between the sensors and the electronic processor, including the output of the electronic processor. Z-axis sensor 227 is preferably an optical reflective object sensor or other non-contact transducer; it detects all possible positions of flat spring 220, which spring is used as an analog for the z-axis position of key 211. Y-axis sensor 228 is preferably an optical reflective object sensor or other non-contact transducer; it detects all possible positions of flat spring 223, which spring is used as an analog for the y-axis position of key 211.

For the purpose of identifying musical intent, key positions are recognized everywhere in the key space, and information about their velocities is derived as well. The microprocessor unit converts sensor information into electronic music control information, as, for example, MIDI (Musical Instrument Digital Interface) data or other music control language forms, for the purpose of controlling sound devices external to the present embodiment. Additionally, the microprocessor unit may control analog output, again for the purpose of controlling external sound devices.

FIGS. 5*a*-5*c*

FIG. 5*a* is a perspective view, from the side and above and partially sectioned, of area 5*a* in FIG. 2*a*. Key guide projection 229 fits without play in a slot 510 in guide plate 230, and passes with clearance through a slot 511 in control rail projection 231 and through a slot 512 in push stop bracket 232. Lateral (x-axis) playing loads are resisted by guide plate 230, which is preferably made of a material having a low coefficient of friction, for example PTFE.

FIG. 5*b* is a front elevational view of pin 229 in slot 510 in guide plate 230 taken at section line 5*b*-5*b* in FIG. 5*a*. Lateral force on key 211 (not shown) causes key projection 229 to rotate in slot 510 in guide plate 230; the circle and tangent line geometry assures a single line of contact for any degree and/or direction of rotation, and thus consistent and low friction.

FIG. 5*c* is a front elevational view of pin 130 in slot 131 in key 123 taken at section line 5*c*-5*c* in prior art FIG. 1*c*. A lateral force, indicated by the arrow, on key 123 causes its slot 131 to bind on pin 130 at contact points 515 and 516. The structure and operation of the present embodiment as detailed in FIG. 5*b* is a distinct advantage, as increased friction from lateral loading, having no controllable musical result, is a distraction to the player.

Referring again to FIG. 5*a*, cushion 236 acts to diminish the horizontal (y-axis) component of key motion through frictional contact at its surface 513 with key guide projection 229. That friction is increased force proportionally with the vertical component of key motion because stop cushion 236 transiently conforms to the shape of key guide projection 229. The vertical component of unguided key motion is dissipated as heat in the interior 514 of cushion 236, which may be advantageously made of a so-called 'skinned elastomer', for example a closed cell urethane foam sold under the trademark Poron by Rogers Corporation, Woodstock, Conn. It is critical that key 211 (not shown), when displaced and released from player control, both return to its center position in the y-axis, that is, that it not be overdamped, and that it do so with little, if any, distracting oscillation, that is, that it not be underdamped. This may be accomplished by varying the durometer and/or the surface of cushion 236, in which case the key/spring system approaches the ideal condition, critical damping.

FIGS. 6*a*-6*b*

FIG. 6*a* enlarges for clarity area 6*a* in FIG. 2*a* of the present embodiment, showing the relationship of key 211 and rocker 215 when the key is centered in the y-axis. Key 211 rests at least on end points 610 and 611 of flat 612, the truncated section of rocker 215's circumferential surface 613, establishing a first, and minimum, extent of separation between key 211 and flat spring 220, as shown in FIG. 2*a*.

FIG. 6*b* enlarges for clarity area 6 in FIG. 2 of the present embodiment, showing a second, increased extent of separation of key 211 and rocker 215 during initial key displacement. The separation between key 211 and flat spring 220, determined by rocker 215, thus also increases.

As rocker 215, driven by the key 211, rotates counterclockwise, end point 610 on flat 612, being in the first quadrant, rises. Thus a portion of playing force directed in the y-axis is converted to z-axis force, urging key 211 upward, providing both a signal of center and a point of stability. When key 211 is fully down (the condition where z-axis flat spring 220 is in firm contact with stop 237), downward force by the player causes a reaction force from the base structure 210, at which point a player can choose, by varying playing pressure downwards, to make the center signal more or less palpable.

FIG. 2*a*

Referencing again FIG. 2*a*, an important articulation in overall musical gesture may be applied when key 211 is moving upward in the z-axis by additionally displacing the key in the y-axis. To accomplish this, the downward force of key 211 and the restoring force exerted by spring 220 are chosen such that, when a player releases a fully depressed key while playing at tempos up to moderato (approximately 110 beats per minute), key 211 accelerates upward quickly enough to enable a player to continuously manipulate key position in the y-axis direction. By way of example, when key 211 is fully up in the z-axis direction, the restoring force of spring 220 must balance the static downward force of the key where it rest on rocker 215, approximately 30 grams, plus an incremental value, typically 40-50 grams, to resist accidental key depression when a player's fingers are resting on, but not actuating, the keys. Thus, if the z-axis flat spring 220 has a working length of 7.9 cm, a width of 1.3 cm, and a thickness of 0.041 cm, and key 211 has a length of 40.6 cm, depressing the key 0.76 cm at its front, a typical distance, generates an additional upward (z-axis) restoring force from spring 220 of approximately 30 grams accelerating key 211 upward.

CONCLUSIONS, RAMIFICATIONS, AND SCOPE

According to the embodiment here presented, we have provided a more controllable and manufacturable dynamic 3-dimensional musical keyboard through improvements to key guidance, damping, centering, and dynamics.

The prior art of Okamoto has the following characteristics which hamper full realization of player control: key displacement so limited as to be unsuited for control of high resolution sonic events, key mounting is subject to both play and increasing friction under the lateral loads incidental to ordinary playing, and no provision is made for physically signaling a key's center position in the y-axis.

In the prior art of Allen, the pin mechanism used to control lateral loads is susceptible to cocking and binding in its associated slot, no means is provided for damping the longitudinal oscillations of an unguided key, and the rear key mount requires a bearing in its upper aspect, at the expense of play which may be amplified over the length of the key. Overall the teaching shows a complexity of parts needing assembly and adjustment, and hampering long term reliability.

Finally, in the prior art of Tripp et al., the rocker assembly comes at the expense of a complexity of elements and of assembly and disassembly when pinning the rocker body both to the leaf spring at one end and the key at the other. No provision is made to damp both the z and y-axis components of unguided longitudinal key motion beyond the damping internal to the springs themselves. There is no means to resist substantially without play and friction lateral loads at the front of the key as longitudinal key guidance is supplied by a pin oriented perpendicularly in a slot, which is thus subject to cocking and binding. Lastly, a second rocker assembly at the rear of the key is complex to manufacture and assemble as well as a source of looseness in the keys and error in their mutual alignment.

The embodiment disclosed herein overcomes each and all of the foregoing limitations through, one, a guidance system having the extreme low friction of single line contact between surfaces, two, an economical, single damper for both the horizontal and vertical components unguided key motion, three, a center signaling support that does not require attachment to the components it separates.

Finally, the prior art fails to recognize that control of key motion in the y-axis (in-and-out) direction is interrupted if the dynamics of the mechanism established by predetermined values of mass and spring force are not properly balanced. Without this control, full realization of artistic intent is not possible.

While the above description contains many specificities, these should not be construed as limitations on the scope of any embodiment, but as exemplifications of the presently preferred embodiment thereof. Different materials, different sizes, different component shapes, for example, may be used without the result differing materially from what is taught here.

Thus the scope of the invention should be determined by the appended claims and their legal equivalents, and not by the examples given.

What is claimed is:

1. In an electronic keyboard musical instrument combination comprising:

a. a base structure, b. a plurality of planar, longitudinally extending keys mounted on said base structure with each key adapted to enable downward depression and backward and forward displacement of the same, said keys being disposed in two ranks whose playing surfaces overlap when keys of either rank are substantially displaced in the direction of their longitudinal axes, c. each key in said plurality having an at-rest position and an active position away from said at-rest position and associated means for limiting key motion when said key is depressed or displaced, d. each key in said plurality having a first resilient support means fixedly secured at one of its ends to the end of said key distal the player and perpendicularly below to said base structure, the foregoing opposing key displacement, and a second resilient support means under said key opposing key depression, e. each key in said plurality having means for establishing a first extent of separation between said key and said second resilient support means when said key is centered in its longitudinal axis and at least a second extent of separation between said key and said second resilient support means when said key is displaced from center in its longitudinal axis, f. each key in said plurality having associated sensing means responsive to key depression and to key displacement to produce signals corresponding thereto for application to electronic digital signal processor means, g. electronic digital signal processor means for receiving said signals in order to produce musical control information corresponding to the signals from said sensing means, an improvement comprising h. in combination, a section of said key and means for constraining said section such that only a single line of contact is established between them when said key is subjected to lateral forces, whereby a player may more facilely and broadly manipulate said keys for musical expression.

2. The apparatus as claimed in claim 1, wherein the section of said key where it contacts said restraining means is a curve of uniform radius.

3. The apparatus as claimed in claim 1, wherein the line of contact of said key with said restraining means lies in said key's longitudinal axis.

4. In an electronic keyboard musical instrument combination comprising:

a. a base structure, b. a plurality of planar, longitudinally extending keys mounted on said base structure with each key adapted to enable downward depression and backward and forward displacement of the same, said keys being disposed in two ranks whose playing surfaces overlap when keys of either rank are substantially displaced in the direction of their longitudinal axes, c. each key in said plurality having an at-rest position and an active position away from said at-rest position and associated means for limiting key motion when said key is depressed or displaced, d. each key in said plurality having a first resilient support means fixedly secured at one of its ends to the end of said key distal the player and perpendicularly below to said base structure, the foregoing opposing key displacement, and a second resilient support means under said key opposing key depression, e. each key in said plurality having means for establishing a first extent of separation between said key and said second resilient support means when said key is centered in its longitudinal axis and at least a second extent of separation between said key and said second resilient support means when said key is displaced from center in its longitudinal axis, f. each key in said plurality having associated sensing means responsive to key depression and to key displacement to produce signals corresponding thereto for application to electronic digital signal processor means, g. electronic digital signal processor means for receiving said signals in order to produce musical control information corresponding to the signals from said sensing means, an improvement comprising h. damping means for each key in said plurality for acting differentially on horizontal and vertical key motions, whereby a player may more facilely and broadly manipulate said keys for musical expression.

5. The apparatus as claimed in claim 4, wherein said damping means is above each key.

6. The apparatus as claimed in claim 4, wherein said damping means is arranged to contact its associated key only when said key is undepressed.

7. The apparatus as claimed in claim 4, wherein said damping means are arranged to diminish the horizontal component of key motion by friction between the surface of said key and the surface of said damping means and the vertical component of key motion is diminished by friction internal to said damping means.

8. The apparatus as claimed in claim 4, wherein said damping means comprises a single material.

9. The apparatus as claimed in claim 8, wherein said single material is an open cell elastomeric foam having a skinned surface.

10. The apparatus as claimed in claim 4 wherein said damping means comprises a first layer for damping key motion in the y-axis direction and a second layer for damping key motion in the z-axis direction.

11. The apparatus as claimed in claim 10, wherein said first layer and said second layer are of different materials.

12. The apparatus as claimed in claim 4, wherein said damping means is arranged to act on the horizontal component of key motion so that damping reaches but does not exceed critical damping.

13. In an electronic keyboard musical instrument combination comprising:

a. a base structure, b. a plurality of planar, longitudinally extending keys mounted on said base structure with each key adapted to enable downward depression and backward and forward displacement of the same, said keys being disposed in two ranks whose playing surfaces overlap when keys of either rank are substantially displaced in the direction of their longitudinal axes, c. each key in said plurality having an at-rest position and an active position away from said at-rest position and associated means for limiting key motion when said key is depressed or displaced, d. each key in said plurality having a first resilient support means fixedly secured at one of its ends to the end of said key distal the player and perpendicularly below to said base structure, the foregoing opposing key displacement, and a second resilient support means under said key opposing key depression, e. each key in said plurality having means for establishing a first extent of separation between said key and said second resilient support means when said key is centered in its longitudinal axis and at least a second extent of separation between said key and said second resilient support means when said key is displaced from center in its longitudinal axis, f. each key in said plurality having associated sensing means responsive to key depression and to key displacement to produce signals corresponding thereto for application to electronic digital signal processor means, g. electronic digital signal processor means for receiving said signals in order to produce musical control information corresponding to the signals from said sensing means, an improvement wherein h. means separating each key and its associated second resilient support means is solely retained by the urging of second resilient support means when said key is in its at-rest position, whereby a player may more facilely and broadly manipulate said keys for musical expression.

14. The apparatus as claimed in claim 13, wherein said means is a rocker mechanism having where it contacts said key an uninterrupted curvilinear perimeter having at least one truncation.

15. In an electronic keyboard musical instrument combination comprising:

a. a base structure, b. a plurality of planar, longitudinally extending keys mounted on said base structure with each key adapted to enable downward depression and backward and forward displacement of the same, said keys being disposed in two ranks whose playing surfaces overlap when keys of either rank are substantially displaced in the direction of their longitudinal axes, c. each key in said plurality having an at-rest position and an active position away from said at-rest position and associated means for limiting key motion when said key is depressed or displaced, d. each key in said plurality having a first resilient support means fixedly secured at one of its ends to the end of said key distal the player and perpendicularly below to said base structure, the foregoing opposing key displacement, and a second resilient support means under said key opposing key depression, e. each key in said plurality having means for establishing a first extent of separation between said key and said second resilient support means when said key is centered in its longitudinal axis and at least a second extent of separation between said key and said second resilient support means when said key is displaced from center in its longitudinal axis, f. each key in said plurality having associated sensing means responsive to key depression and to key displacement to produce signals corresponding thereto for application to electronic digital signal processor means, g. electronic digital signal processor means for receiving said signals in order to produce musical control information corresponding to the signals from said sensing means, an improvement wherein h. each key in said plurality of keys is thin, but rigid having low mass and a low friction linkage at the front of the key while said second resilient means is a strong flat spring interacting with said means for separation urging at the front portion of the key to provide a more responsive upward acceleration than known keys, whereby the resultant upward acceleration of said key from its fully depressed position substantially sustains contact with the player's finger for musical tempos up to approximately 110 beats per minute, and whereby a player may more facilely and broadly manipulate said keys for musical expression.

* * * * *